US008984682B2

(12) United States Patent
Zhao

(10) Patent No.: US 8,984,682 B2
(45) Date of Patent: Mar. 24, 2015

(54) REVERSIBLE PLATFORM AND CRIB THEREWITH

(75) Inventor: Guang-Hui Zhao, Guangdong (CN)

(73) Assignee: Wonderland Nurserygoods Company Limited, Kwai Chung (HK)

( * ) Notice: Subject to any disclaimer, the term of this patent is extended or adjusted under 35 U.S.C. 154(b) by 383 days.

(21) Appl. No.: 13/370,324

(22) Filed: Feb. 10, 2012

(65) Prior Publication Data

US 2012/0204347 A1 Aug. 16, 2012

(30) Foreign Application Priority Data

Feb. 15, 2011 (CN) ..... 2011 1 0038471

(51) Int. Cl.

| | |
|---|---|
| ***A47D 7/00*** | (2006.01) |
| ***A47D 13/06*** | (2006.01) |
| ***A47D 9/00*** | (2006.01) |
| ***A47D 5/00*** | (2006.01) |

(52) U.S. Cl.

CPC ..... *A47D 9/005* (2013.01); *A47D 5/006* (2013.01); *A47D 13/063* (2013.01)

USPC ..... 5/93.1; 5/93.2; 5/98.1; 5/98.2; 5/99.1; 5/100

(58) Field of Classification Search

USPC ..... 5/93.1–100; 24/72.5, 529, 532, 536, 24/3.12

See application file for complete search history.

(56) References Cited

U.S. PATENT DOCUMENTS

| | | | | |
|---|---|---|---|---|
| 6,099,377 | A * | 8/2000 | Pridemore | 446/227 |
| 6,543,070 | B2 * | 4/2003 | Longenecker et al. | 5/93.1 |
| 6,948,197 | B1 | 9/2005 | Chen | |
| 7,950,081 | B2 * | 5/2011 | Chen et al. | 5/93.2 |
| 8,011,036 | B2 * | 9/2011 | Tuckey | 5/93.1 |
| 8,230,536 | B2 * | 7/2012 | Clapper et al. | 5/93.2 |
| 8,544,125 | B2 * | 10/2013 | Greger et al. | 5/99.1 |
| 2006/0130237 | A1 | 6/2006 | Clapper | |
| 2008/0034506 | A1 | 2/2008 | Chen | |
| 2013/0047335 | A1 * | 2/2013 | Zeng et al. | 5/93.1 |
| 2013/0326808 | A1 * | 12/2013 | Saint et al. | 5/93.1 |

FOREIGN PATENT DOCUMENTS

| | | |
|---|---|---|
| DE | 199 41 332 A1 | 3/2000 |
| DE | 10 2011 109 874 A1 | 3/2012 |

OTHER PUBLICATIONS

Kobisofer: "Graco Pack 'n' Play with Reversible Napper & Changer", Jan. 24, 2012, YouTube video [online], Available from http://www.youtube.com/watch?v=2bnQGAPiwis.

Product Owner's Manual [online], see PDF file p. 20-33 http://download.gracobaby.com/ProductInstructionManuals/PD187603A.pdf, 2011.

* cited by examiner

*Primary Examiner* — Robert G Santos
*Assistant Examiner* — David E Sosnowski
(74) *Attorney, Agent, or Firm* — Winston Hsu; Scott Margo

(57) ABSTRACT

A reversible platform and a crib therewith are disclosed. The reversible platform includes a pivotally-engaging mechanism and a bracket. The pivotally-engaging mechanism is disposed on a crib frame. The bracket is connected to the crib frame through the pivotally-engaging mechanism. The bracket has a first side and a second side opposite to the first side. The bracket is capable of being rotated to be disposed selectively with the first side or the second side facing upward for providing application space. Thereby, the invention can provide two application platforms with one occupied space of the crib frame, so as to solve the issue in the prior art that additional accessories provided for a conventional crib is provided for multiple functions occupy more space and the operation therefor is usually inconvenient to users.

29 Claims, 17 Drawing Sheets

REVERSIBLE PLATFORM AND CRIB THEREWITH

BACKGROUND OF THE INVENTION

1. Field of the Invention

The invention relates to a platform for crib and a crib, and especially relates to a reversible platform and a crib therewith.

2. Description of the Prior Art

A crib is one of essential household appliances for a family having infants. In general, for the structure design of a current crib, the crib mainly includes a crib frame for supporting and a covering member installed on the crib frame for protection; thereby, an infant can be placed thereon by a caregiver. As technology develops, for the requirements for multi-functional cribs by users, the current crib is often provided with many additional accessories for the crib frame, for example, sleeping napper and baby changer, so as to improve the utility of the crib.

However, the current crib is provided with the sleeping napper and the baby changer disposed side by side on the crib frame. The above arrangement occupies a larger space of the crib, leading to occupancy of space. In addition, some cribs are provided with detachable baby changers. In such case, the baby changer can be detached from the crib or pivot on a side of the crib to a store position outside the crib after use. It may save space for the occupation by the baby changer, but the pivotal structure thereof is so complicated as to be very inconvenient to users.

SUMMARY OF THE INVENTION

An objective of the invention is to provide a reversible platform. The reversible platform uses a reversible mechanism to provide two applications to users but only occupies one disposition space.

The reversible platform of the invention is used on a crib frame and includes a pivotally-engaging mechanism and a bracket. The pivotally-engaging mechanism is disposed on the crib frame. The bracket is pivotally connected to the crib frame through the pivotally-engaging mechanism and has a first side and a second side opposite to the first side. The bracket is capable of being rotated to be disposed selectively with the first side or the second side facing upward for providing application space. In practice, a flexible part can be mounted on the first side of the bracket to form a baby changer; similarly, another flexible part can be mounted on the second side of the bracket to form a sleeping napper. Thereby, a user can easily turn the bracket through the pivotally-engaging mechanism to selectively use the first side or the second side of the bracket within the same occupied space for required applications, for example a baby changer or a sleeping napper, but the invention is not limited thereto. Therefore, the reversible platform of the invention can provide two application platforms with one occupied space of the crib frame, which solves the problem in the prior art that additional accessories provided for a conventional crib is provided for multiple functions occupy more space and the operation therefor is usually inconvenient to users.

Another objective of the invention is to provide a crib having a reversible platform according to the invention. The crib includes a crib frame and a reversible platform. The reversible platform is disposed on the crib frame and includes a pivotally-engaging mechanism and a bracket. The pivotally-engaging mechanism is disposed on the crib frame. The bracket is pivotally connected to the crib frame through the pivotally-engaging mechanism and has a first side and a second side opposite to the first side. The bracket is capable of being rotated to be disposed selectively with the first side or the second side facing upward for providing application space. Similarly, a user can easily turn the bracket through the pivotally-engaging mechanism to selectively use the first side or the second side of the bracket within the same occupied space for required applications, and the crib is multi-functional without occupying much space, which solves the problem in the prior art that the additional accessories occupy more space and the operation therefor is usually inconvenient to users.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
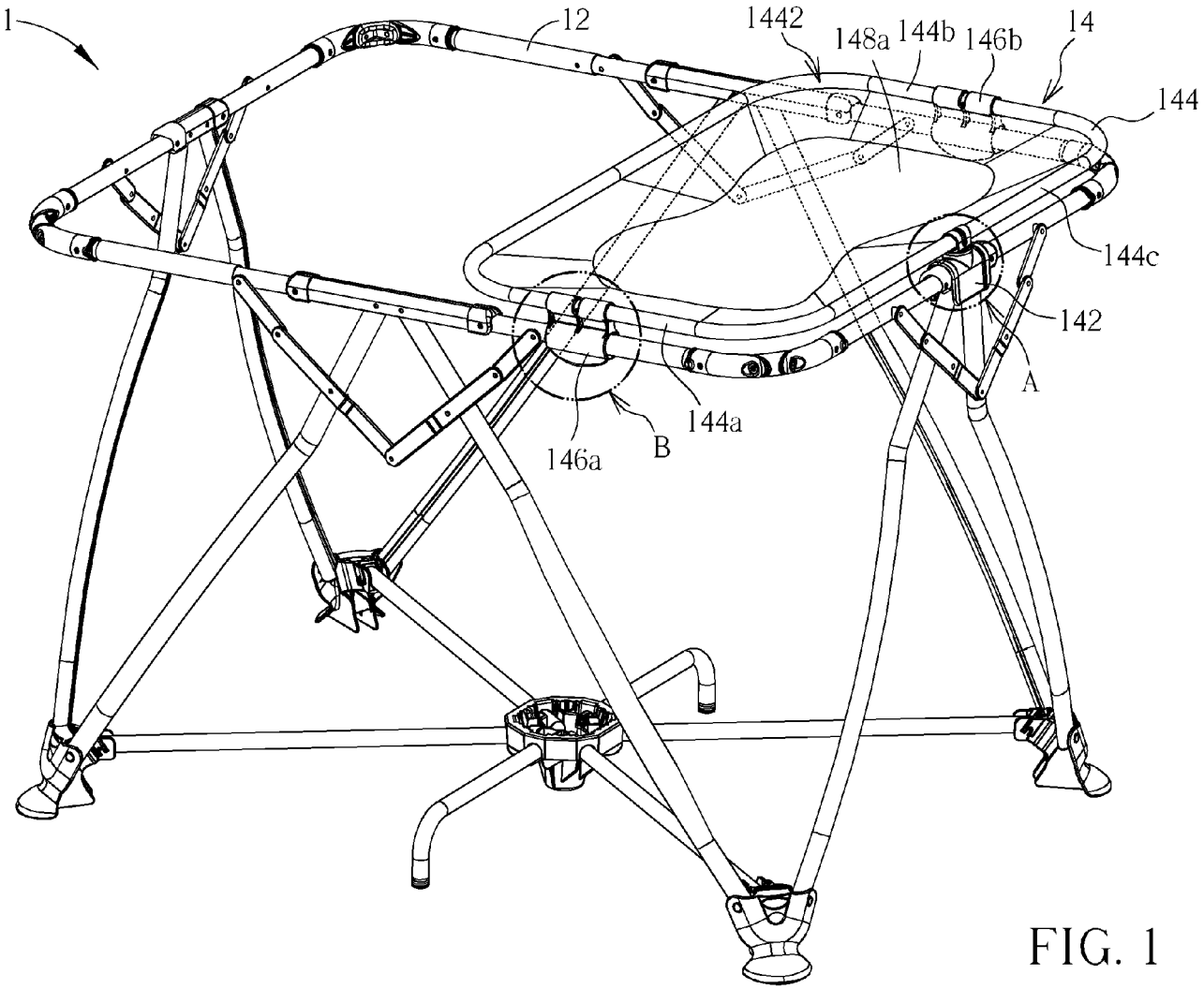
FIG. 1 is a schematic diagram illustrating a crib of a preferred embodiment according to the present invention.

Please refer to FIG. 1, which is a schematic diagram illustrating a crib 1 of a preferred embodiment according to the present invention. For clear illustration, the covering member, for example, made of cloth for the crib 1 is not shown in FIG. 1. In the embodiment, the crib 1 includes a crib frame 12 and a reversible platform 14. The reversible platform 14 includes a pivotally-engaging mechanism 142, a bracket 144, a first supporting mechanism 146*a*, and a second supporting mechanism 146*b*. The pivotally-engaging mechanism 142 is disposed on the crib frame 12. The bracket 144 is pivotally connected to the crib frame 12 through the pivotally-engaging mechanism 142. The supporting mechanisms 146*a* and 146*b* are pivotally connected to the bracket 144 oppositely and detachably hold the crib frame 12. Thereby, in an application change for the reversible platform 14, the supporting mechanisms 146*a* and 146*b* can be detached from the crib frame 12 first; then, the bracket 144 can be turned over through the pivotally-engaging mechanism 142; at last, the supporting mechanisms 146*a* and 146*b* hold the crib frame 12 again. Therefore, the reversible platform 14 can provide two applications by two sides of the bracket 144 with only one occupied space. The mechanism of the components of the crib is going to be described in detail in the following.

Figure 2:
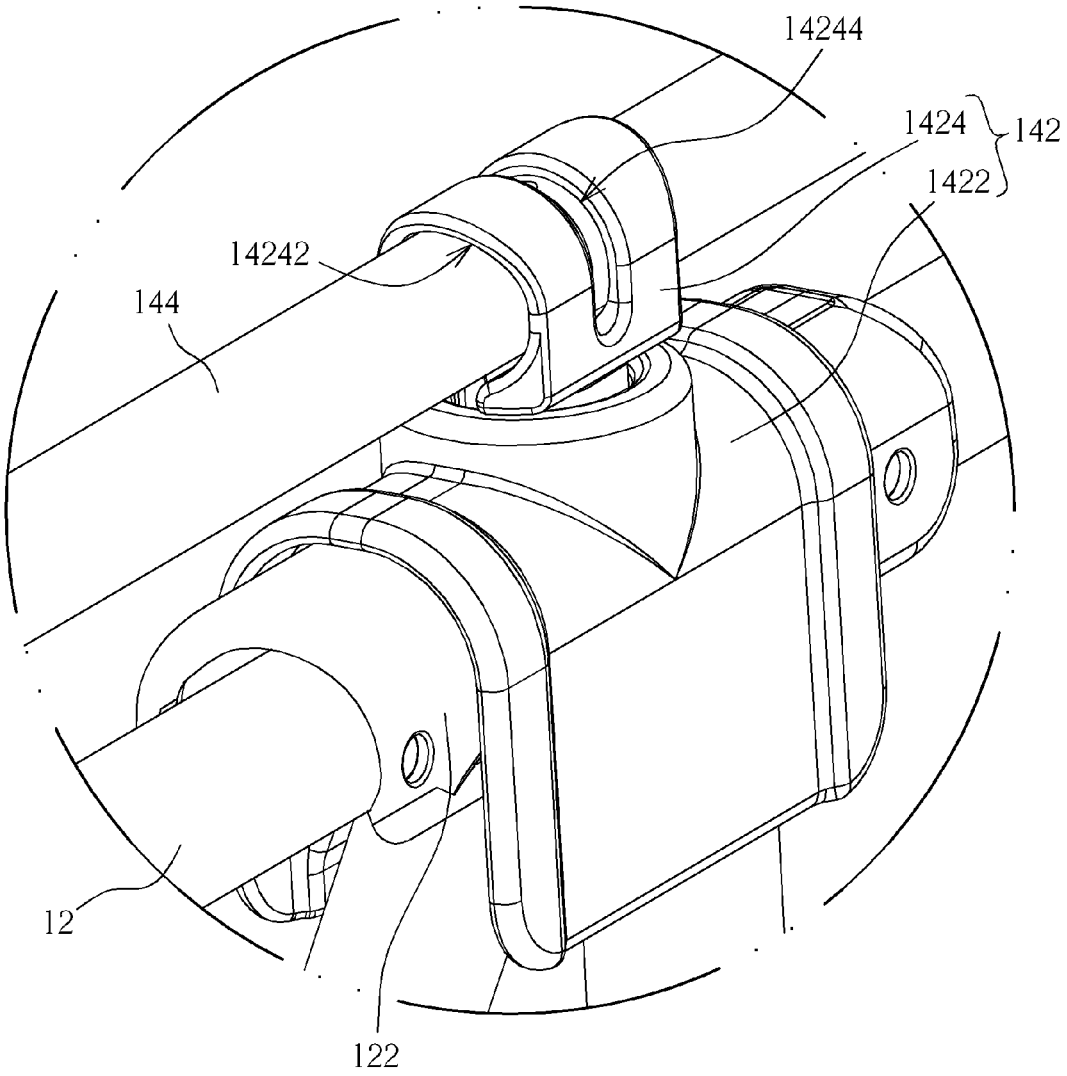
FIG. 2 is an enlarge view of the circle A in FIG. 1 for illustrating a pivotally-engaging mechanism of a reversible platform of the crib.
Figure 3:
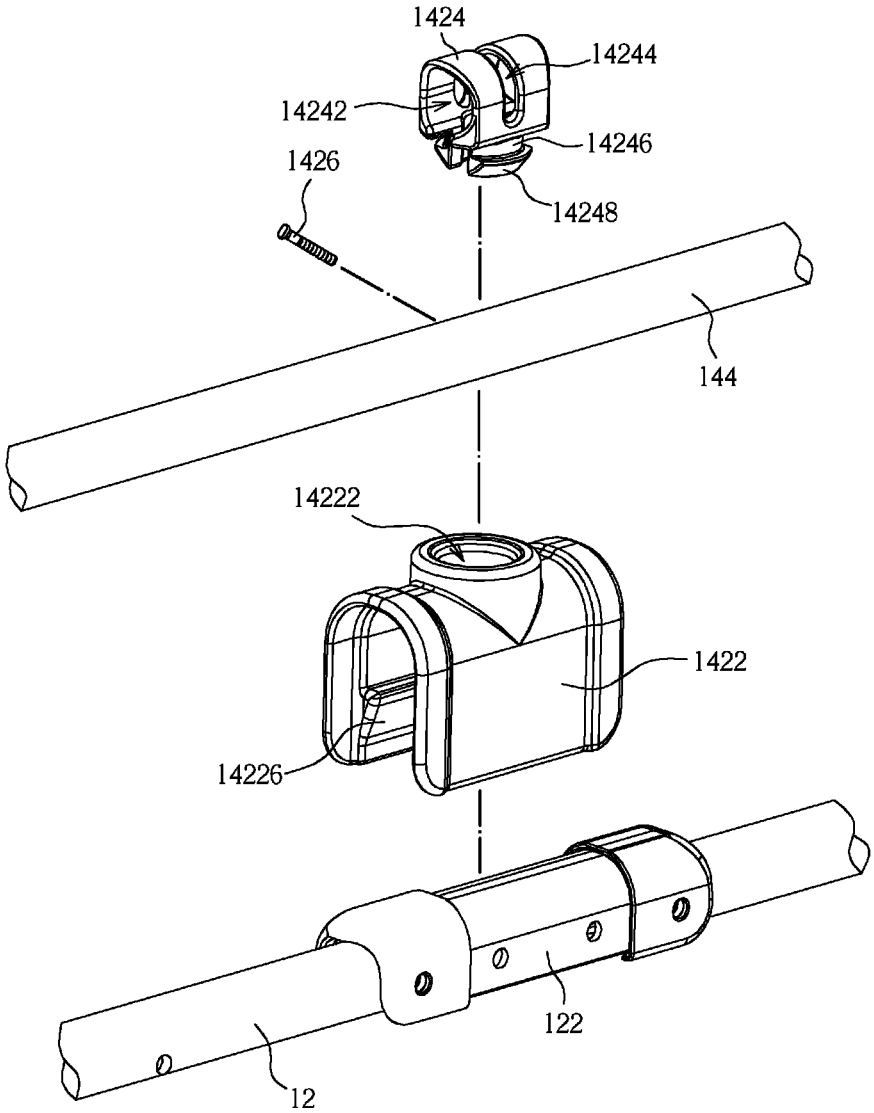
FIG. 3 is an exploded view of the pivotally-engaging mechanism in FIG. 2.
Figure 4:
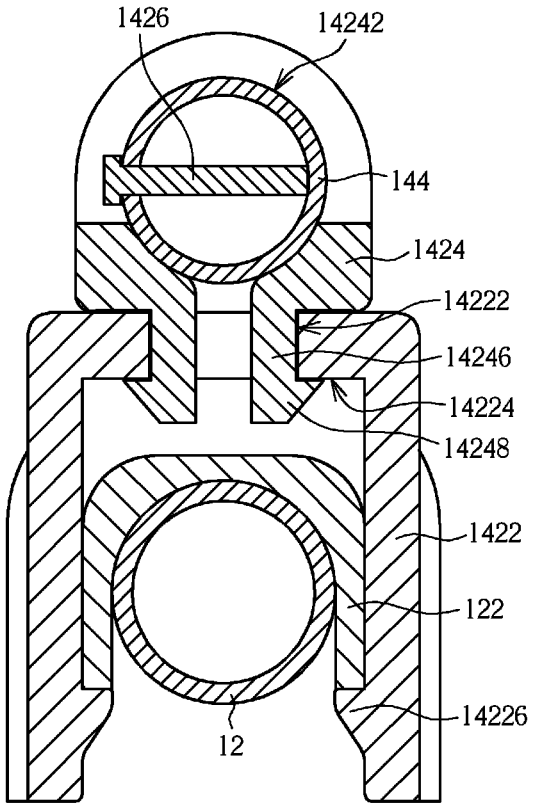
FIG. 4 is a sectional view of the pivotally-engaging mechanism in FIG. 2.

Please refer to FIGS. 1 through 4. FIG. 2 is an enlarge view of the circle A in FIG. 1 for illustrating the pivotally-engaging mechanism 142. FIG. 3 is an exploded view of the pivotally-engaging mechanism 142 in FIG. 2. FIG. 4 is a sectional view of the pivotally-engaging mechanism 142 in FIG. 2; the cutting plane therefor is located at the middle of the pivotally-engaging mechanism 142 and perpendicular to the axis of the bracket 144. The pivotally-engaging mechanism 142 includes a base part 1422, mounted on the crib frame 12, and a connection part 1424, pivotally connected to the base part 1422. The bracket 144 is connected to the connection part 1424. In the embodiment, the connection part 1424 has a hole 14242 and a limitation slot 14244. The bracket 144 is pivotally connected to the connection part by passing through the hole 14242. The pivotally-engaging mechanism 142 further comprises a limitation part 1426 mounted on the bracket 144 and sliding limitedly in the limitation slot 14244. Under the limitation on the limitation part 1426 by the limitation slot 14244, the bracket 144 may rotate relative to the connection part 1424 within 180 degrees. The limitation slot 14244 is conducive to positioning the bracket 144; however, in practice, the above limitation design can be omitted so that the bracket 144 can rotate relative to the connection part 1424 free.

Furthermore, the base part 1422 has a hole 14222, a first engagement portion 14224, and a second engagement portion 14226. The connection part 1424 has a pivot 14246 with a hook 14248. The pivot 14246 is pivotally disposed in the hole 14222 so that the connection part 1424 can rotate relative to the base part 1422 free; the hook 14248 is engaged with the first engagement portion 14224 so as to prevent the connection part 1424 from escaping entirely from the base part 1422. In the embodiment, the first engagement portion 14224 is realized by a shoulder structure adjacent to the hole 14222, but the invention is not limited thereto. The crib frame 12 has a mounting base 122 thereon. The second engagement portion 14226 is engaged with the mounting base 122. In the embodiment, the second engagement portion 14226 is realized by two hooks disposed oppositely to hold the bottom of the mounting base 122, but the invention is not limited thereto.

Figure 5:
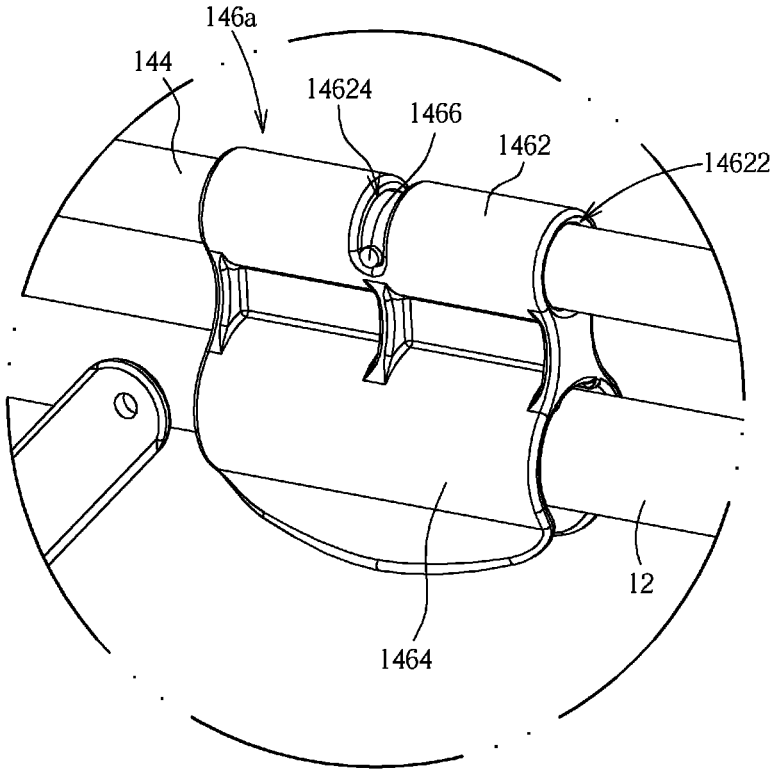
FIG. 5 is an enlarge view of the circle B in FIG. 1 for illustrating a supporting mechanism of the reversible platform.
Figure 6:
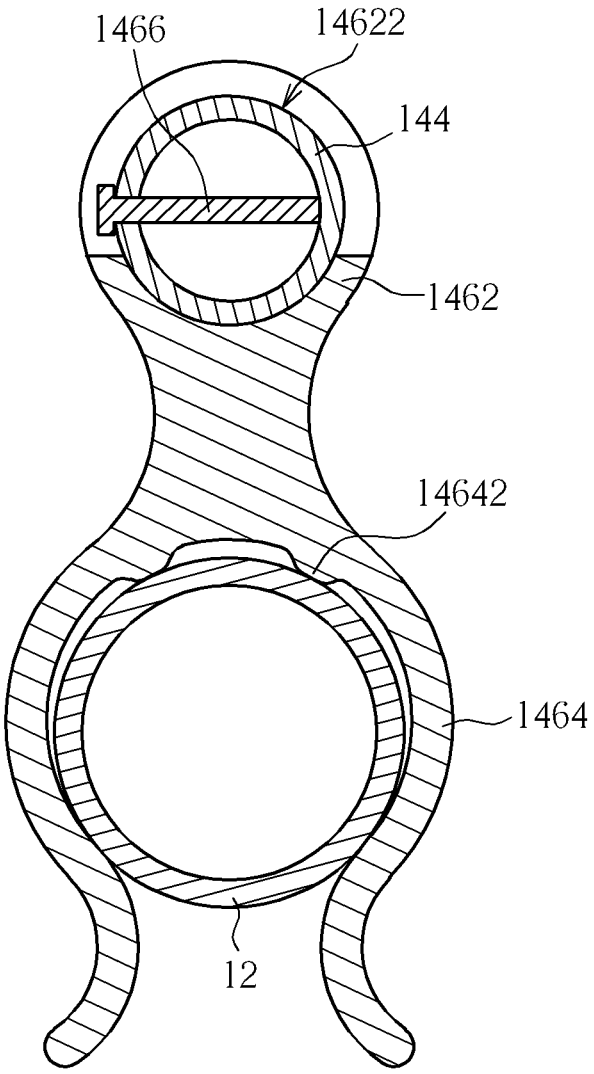
FIG. 6 is a sectional view of the supporting mechanism in FIG. 5.

Please refer to FIGS. 1, 5 and 6. FIG. 5 is an enlarge view of the circle B in FIG. 1 for illustrating the supporting mechanism 146*a*. FIG. 6 is a sectional view of the supporting mechanism 146*a* in FIG. 5; the cutting plane therefor is located at the middle of the supporting mechanism 146*a* and perpendicular to the axis of the bracket 144. The supporting mechanism 146*a* includes a connection part 1462 and a holding part 1464 connected to the connection part 1462. The bracket 144 is connected to the connection part 1462 such that the holding part 1464 is capable of rotating relative to the bracket 144. In the embodiment, the connection part 1462 has a hole 14622 and a limitation slot 14624. The bracket 144 is pivotally connected to the connection part 1462 by passing through the hole 14622. The supporting mechanism 146*a* further comprises a limitation part 1466 mounted on the bracket 144 and sliding limitedly in the limitation slot 14624. Under the limitation on the limitation part 1466 by the limitation slot 14624, the supporting mechanism 146*a* (or the holding part 1464) may rotate relative to the bracket 144 within 180 degrees.

The limitation slot 14624 is conducive to positioning the bracket 144 and remaining the relative position between the supporting mechanism 146*a* and the bracket 144; however, in practice, the above limitation design can be omitted so that the supporting mechanism 146*a* can rotate relative to the bracket 144 free, and the relative position between the supporting mechanism 146*a* and the bracket 144 can be adjustable. Moreover, the holding part 1464 is an elastic C-shaped structure with a guiding structure at its opening, so the holding part 1464 can detachably hold the crib frame 12. In the embodiment, the holding part 1464 includes two ribs 14642 on the inner surface of the C-shaped structure opposite to the opening, which is conducive to holding the crib frame 12 stably and firmly.

In the embodiment, the supporting mechanism 146*b* is identical to the supporting mechanism 146*a*, so please refer to the above for the description for the supporting mechanism 146*b*. However, the invention is not limited thereto. In practice, the supporting mechanism 146*b* can be another kind different to the supporting mechanism 146*a*. For example, the supporting mechanism can be designed to hold the crib frame 12 by magnetic attraction instead of the structural holding design, when the crib frame 12 is magnetic.

Figure 7:
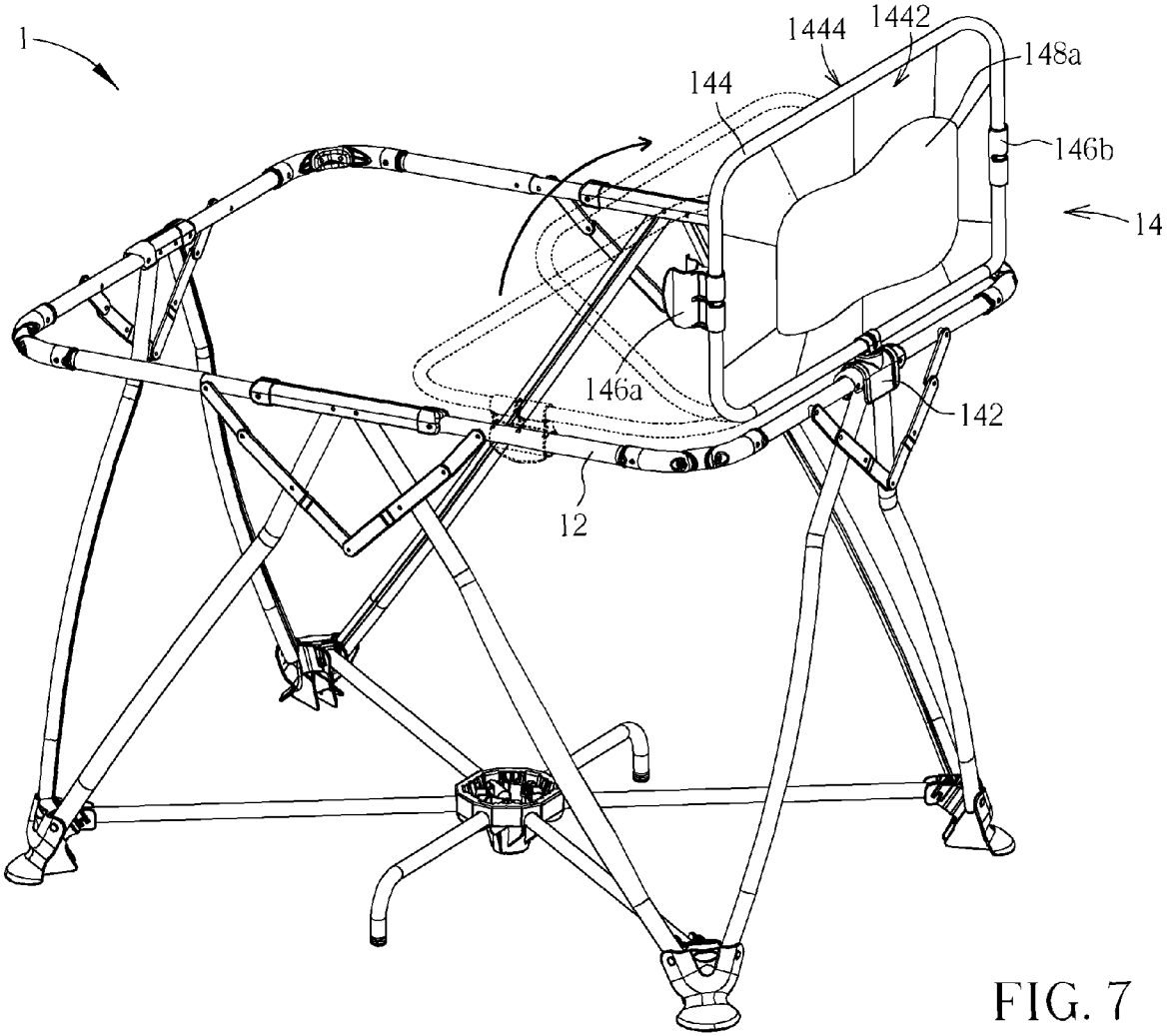
FIGS. 7 through 9 are schematic diagrams illustrating the operation of turning over the bracket of the reversible platform in FIG. 1.
Figure 8:
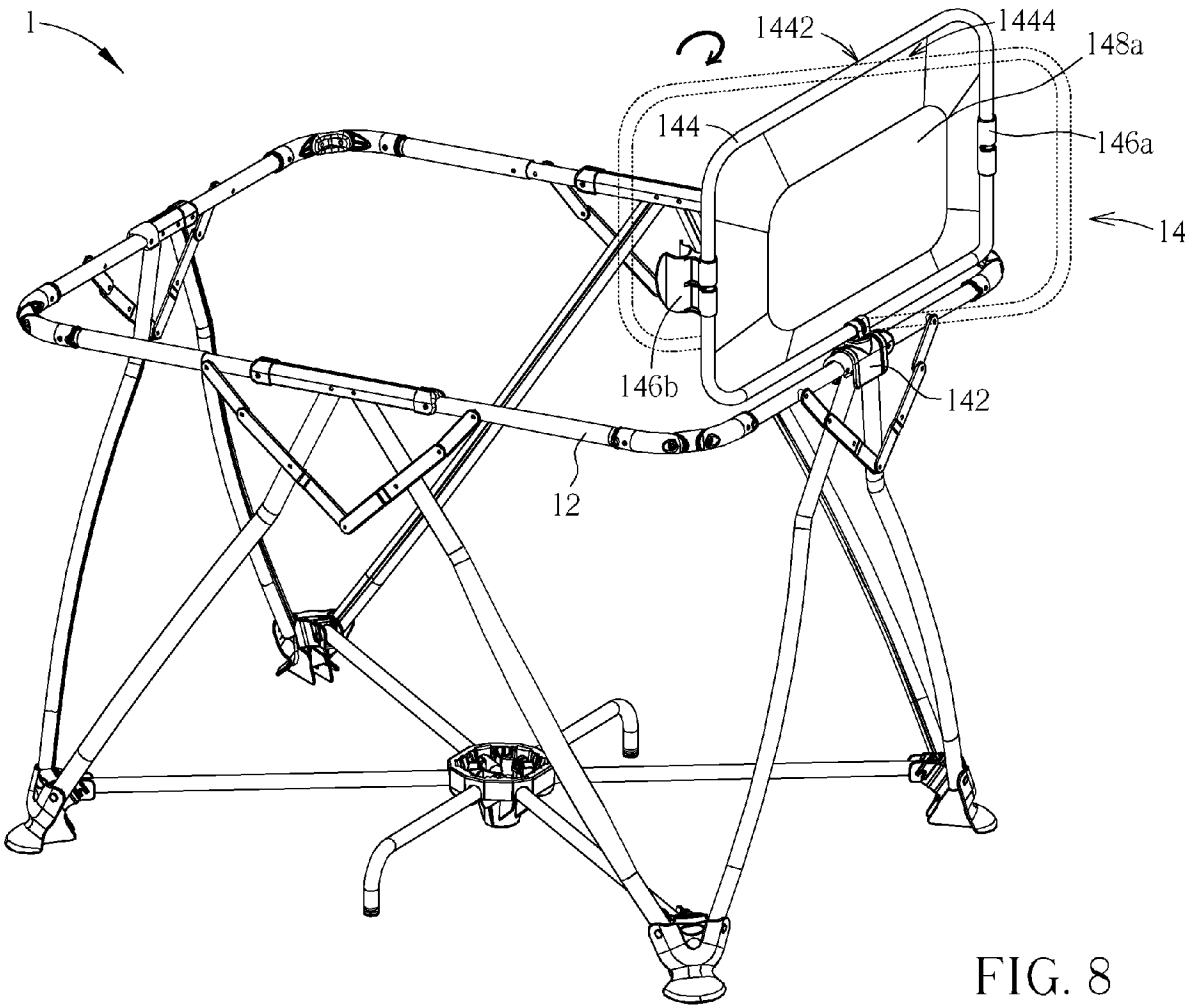
Figure 9:
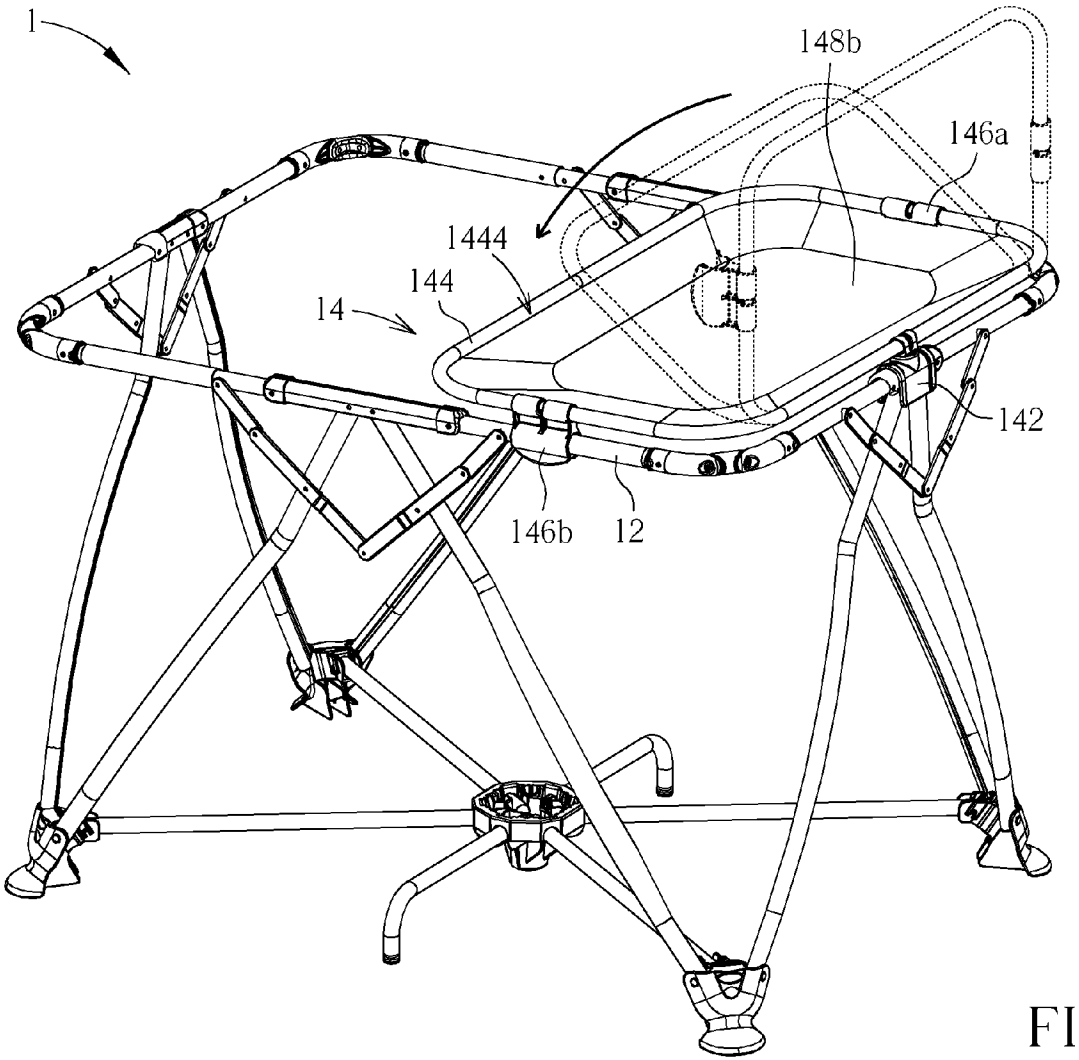

Please refer to FIG. 1 and FIGS. 7 through 9. FIGS. 7 through 9 are schematic diagrams illustrating the operation of turning over the bracket 144 so as to make use of the other side of the bracket 144. The bracket 144 has a first side 1442 and a second side 1444 opposite to the first side 1442. In the embodiment, the reversible platform 14 includes a first flexible part 148*a* and a second flexible part 148*b*. The first flexible part 148*a* is mounted on the first side 1442 to form a baby changer, as shown in FIG. 7 (or FIG. 1). The second flexible part 148*b* is mounted on the second side 1444 to form a sleeping napper, as shown in FIG. 9. In practice, for the requirements of the baby changer, the first flexible part 148*a* can be made of cloth of water-proof and easily-cleaning material such as EVA, PVC and so on. Similarly, for the requirements of the sleeping napper, the second flexible part 148*b* can be made of cloth of soft material such as cotton, flannel, velvet and so on. But the invention is not limited thereto.

When a user needs to use the sleeping napper, the user can lift the bracket 144 first such that the supporting mechanisms 146*a* and 146*b* are detached from the crib frame 12, and then rotate the bracket 144 about the pivotally-engaging mechanism 142 (actually about the connection part 1424) upward in about 90 degrees, as shown in FIG. 7. Afterward, the user can rotate the bracket 144 about the pivotally-engaging mechanism 142 clockwise or counterclockwise in about 180 degrees, as shown in FIG. 8; at the same time, the supporting mechanisms 146*a* and 146*b* are also rotated in about 180 degrees. At last, the user can rotate the bracket 144 down about the pivotally-engaging mechanism 142 till the supporting mechanisms 146*a* and 146*b* are attached onto the crib frame 12 again, as shown in FIG. 9. At this time, the second side 1444 of the bracket 144 faces upward, and the user can use the sleeping napper now. Similarly, if the user needs to use the baby changer again, the user can perform the above operation again to make the first side 1442 of the bracket 144 face upward for the usage of the baby changer. Thereby, the bracket 144 is capable of being rotated to be disposed selectively with the first side 1442 or the second side 1444 facing upward for providing application space such as for the baby changer and the sleeping napper to the user.

In the embodiment, the supporting mechanisms 146*a* and 146*b* are identical and disposed oppositely on the bracket 144, exactly on a first handrail 144*a* and a second handrail 144*b* of the bracket 144, as shown in FIG. 1. Furthermore, the pivotally-engaging mechanism 142 is located on a third handrail 144*c* between the first handrail 144*a* and the second handrail 144*b*. But the invention is not limited thereto. For example, in an embodiment, the pivotally-engaging mechanism 142 can be disposed on the first handrail 144*a;* the supporting mechanisms 146*a* and 146*b* are disposed on the second handrail 144*b* and the third handrail 144*c* respectively. In such disposition, the reversible platform 14 still can be supported stably on the crib frame 12 and operate normally.

Figure 10:
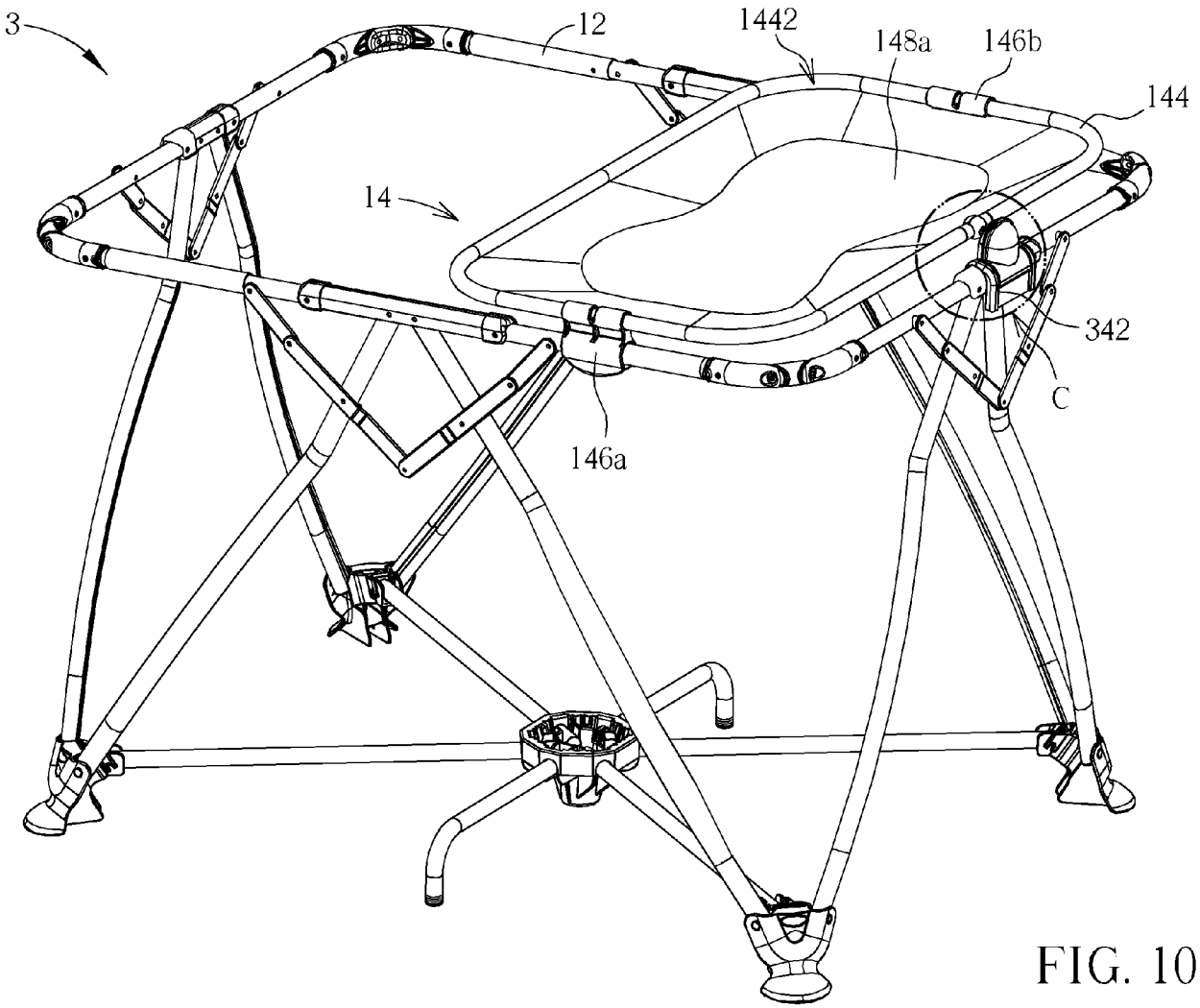
FIG. 10 is a schematic diagram illustrating a crib of another preferred embodiment according to the present invention.
Figure 11:
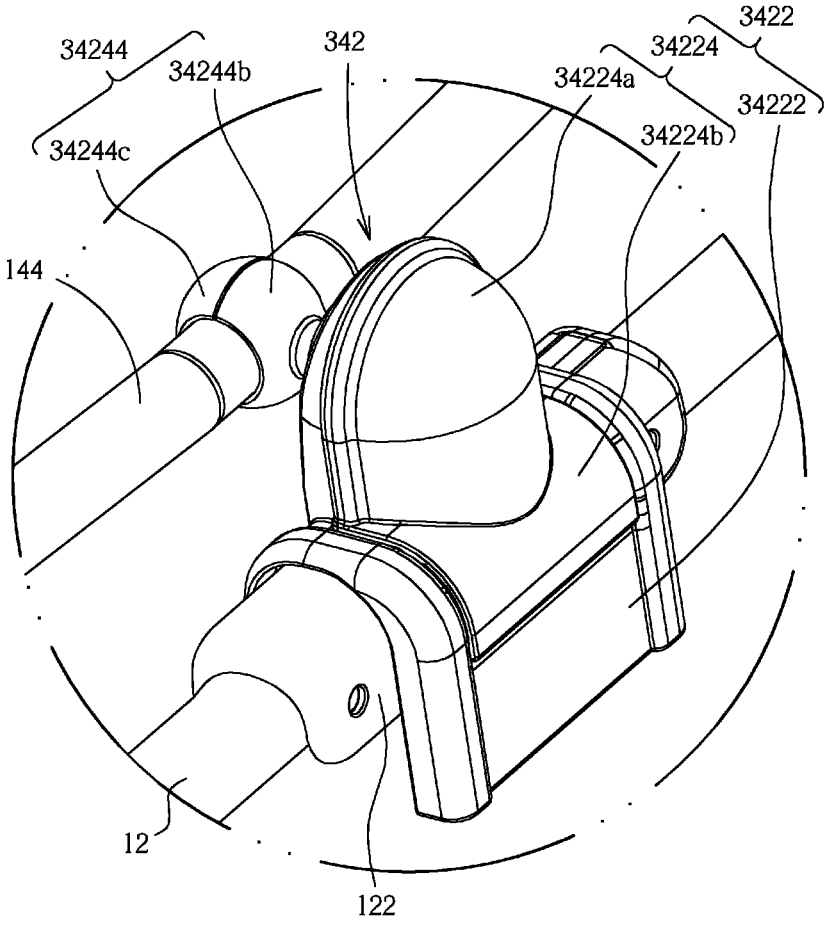
FIG. 11 is an enlarge view of the circle C in FIG. 10 for illustrating a pivotally-engaging mechanism of a reversible platform of the crib.
Figure 12:
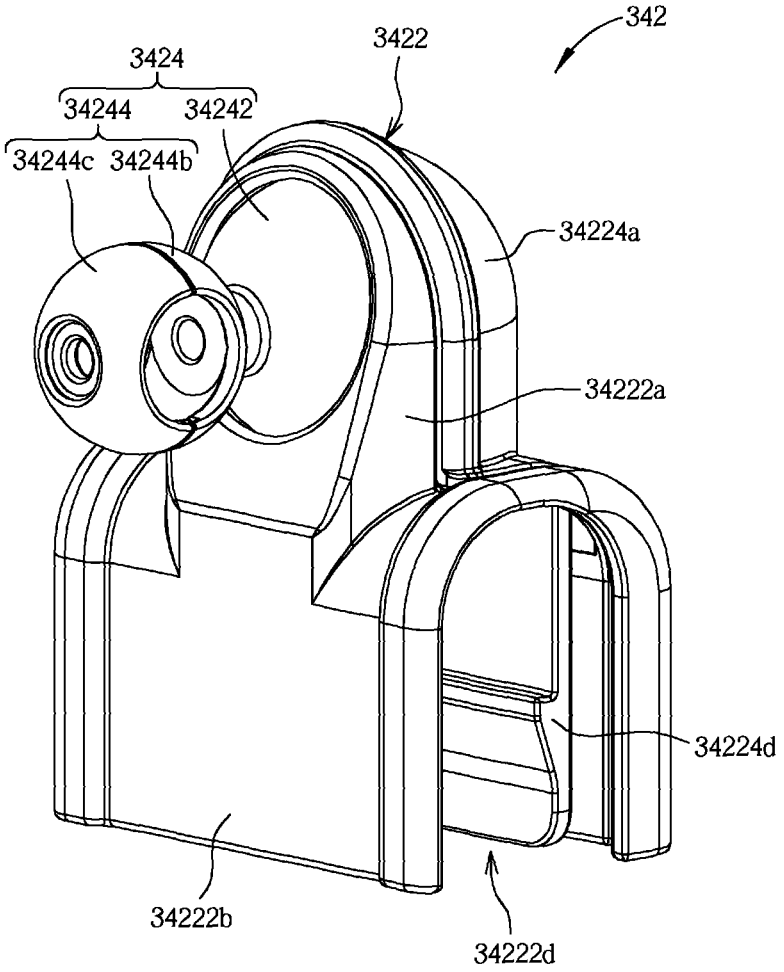
FIG. 12 is a schematic diagram illustrating the pivotally-engaging mechanism in FIG. 10.
Figure 13:
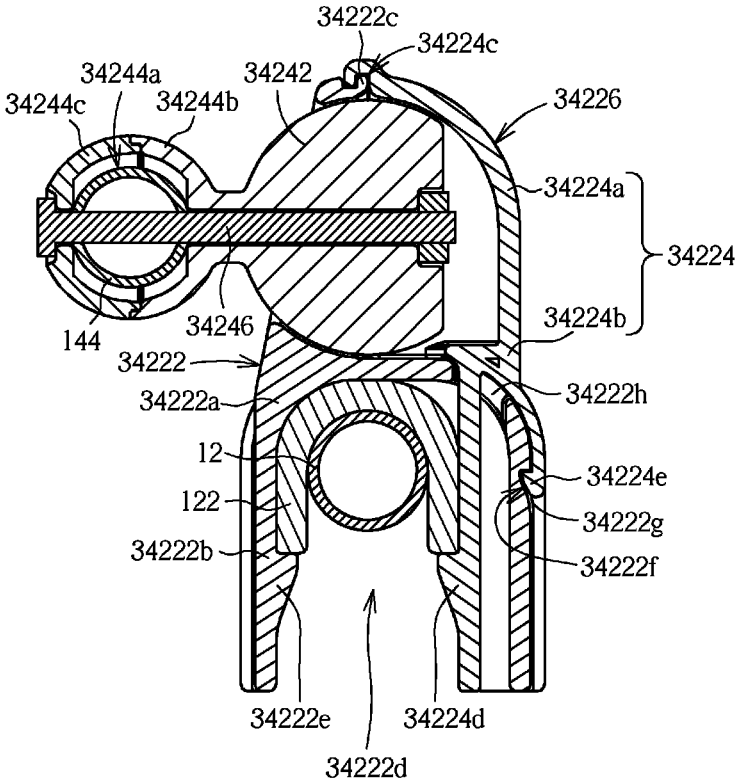
FIG. 13 is a sectional view of the pivotally-engaging mechanism in FIG. 11.

In the above embodiments, the pivotally-engaging mechanism 142 uses two pivotal joints to provide the turning-over mechanism to the bracket 144. But the invention is not limited to the pivotally-engaging mechanism 142. Please refer to FIG. 10, which is a schematic diagram illustrating a crib 3 of another preferred embodiment according to the present invention. The crib 3 is structurally similar to the crib 1. The main difference therebetween is that the pivotally-engaging mechanism 342 of the crib 3 is different to the pivotally-engaging mechanism 142 of the crib 1. Please also refer to FIGS. 11 through 13. FIG. 11 is an enlarge view of the circle C in FIG. 10 for illustrating the pivotally-engaging mechanism 342. FIG. 12 is a schematic diagram illustrating the pivotally-engaging mechanism 342. FIG. 13 is a sectional view of the pivotally-engaging mechanism 342 in FIG. 11; the cutting plane therefor is located at the middle of the pivotally-engaging mechanism 342 and perpendicular to the axis of the bracket 144.

The pivotally-engaging mechanism 342 includes a base part 3422, mounted on the crib frame 12, and a connection part 3424, pivotally connected to the base part 3422, and the bracket 144 is connected to the connection part 3424. In the embodiment, the base part 3422 includes a front casing member 34222 and a back casing member 34224. The front casing member 34222 has a socket opening portion 34222*a* and a first mounting portion 34222*b*. The back casing member 34224 has a socket back cover portion 34224*a* and a second mounting portion 34224*b*. The socket back cover portion 34224*a* is engaged with the socket opening portion 34222*a* by the engagement of a rib 34222*c* (or taken as a groove in practice) formed on the socket opening portion 34222*a* with a groove 34224*c* formed on the socket back cover portion 34224*a* to form a socket 34226. The first mounting portion 34222*b* forms an accommodating space 34222*d* and has a first hook 34222*e* in the accommodating space 34222*d* and a slot 34222*f* formed on an outer surface 34222*g* thereof. The second mounting portion 34224*b* has a second hook 34224*d*, disposed in the accommodating space 34222*d* through a channel 34222*h* formed on the first mounting portion 34222*b*, and a third hook 34224*e*, engaged with the slot 34222*f*. The mounting base 122 of the crib frame 12 is disposed in the accommodating space 34222*d* to be engaged with the first hook 34222*e* and the second hook 34224*d*.

The connection part 3424 has a ball portion 34242, pivotally disposed in the socket 34226 through the socket opening portion 34222*a,* and a connecting portion 34244, connected to the ball portion 34242. The connecting portion 34244 has a hole 34244*a*. The bracket 144 passes through the hole 34244*a*. In the embodiment, for convenience during assembly of the bracket 144 with the connecting portion 34244, the connecting portion 34244 is formed by a fixed portion 34244*b*, fixedly connected to the ball portion 34242, and a ball cover 34244*c*, engaged with the fixed portion 34244*b* after the bracket 144 disposed on the fixed portion 34244*b* for holding the bracket 144. Furthermore, the bracket 144 is also fixed with the connecting portion 34244 by a fixing part 34246 (not shown in FIG. 12), for example a screw with a nut, so that the bracket 144 moves together with the connection part 3424. In other words, the movement of the bracket 144 is constrained by the socket 34226 (exactly by the socket opening portion 34222*a*). Hence, the turning-over operation of the bracket 144 is performed by the ball portion 34242 rotating in the socket 34226. However, the invention is not limited thereto. For example, the bracket 144 still can be pivotally connected to the connection part 3424 by passing through the hole 34244*a* without being fixed, so as to be capable of rotating relative to the connecting portion 34244 free, which increases the flexibility of the turning-over operation for the user. The turning-over operation for the bracket 144 of the crib 3 based on the pivotally-engaging mechanism 342 is similar to that based on the pivotally-engaging mechanism 142 and is not described again herein.

Figure 14:
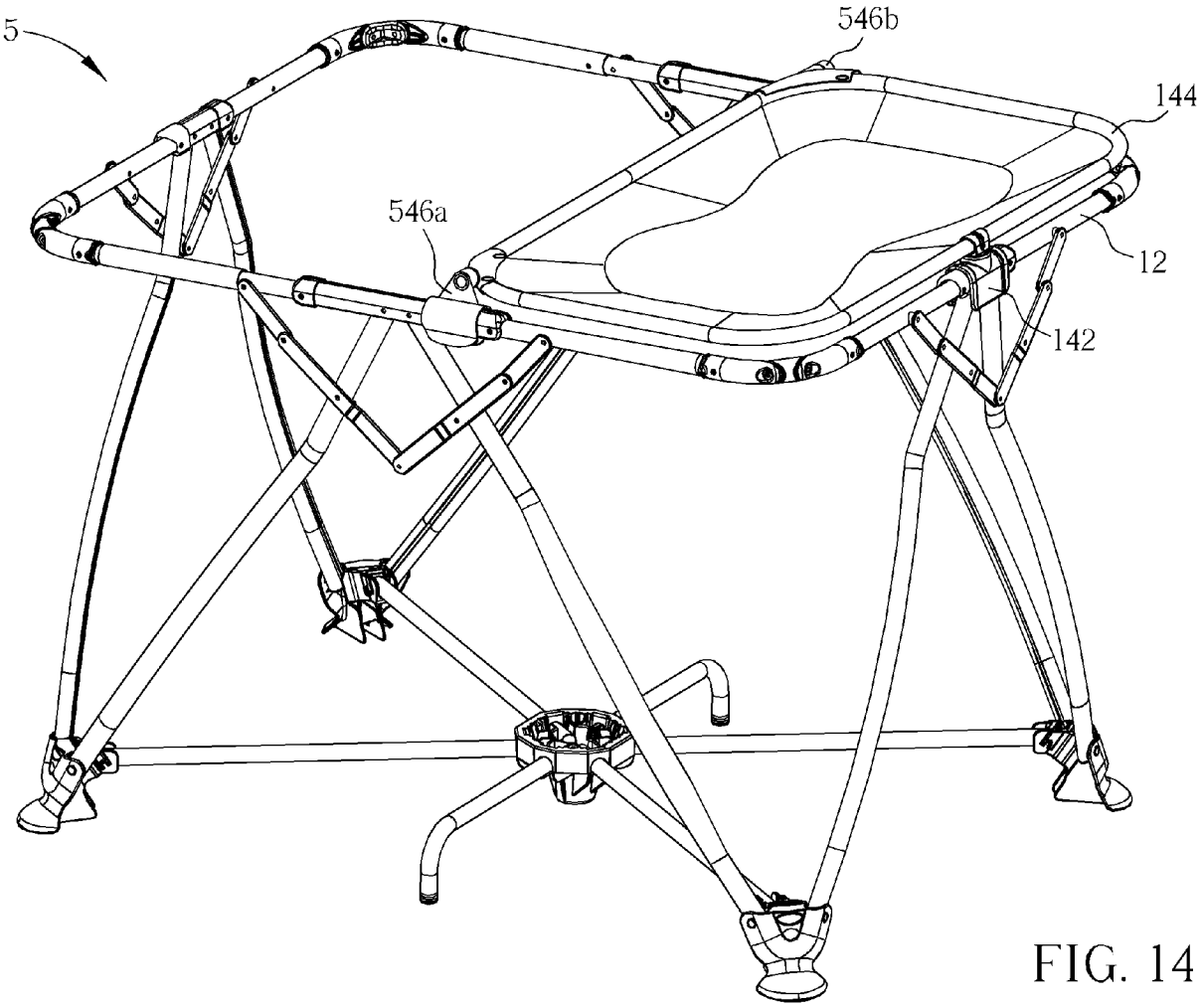
FIG. 14 is a schematic diagram illustrating a crib of another preferred embodiment according to the present invention.
Figure 15:
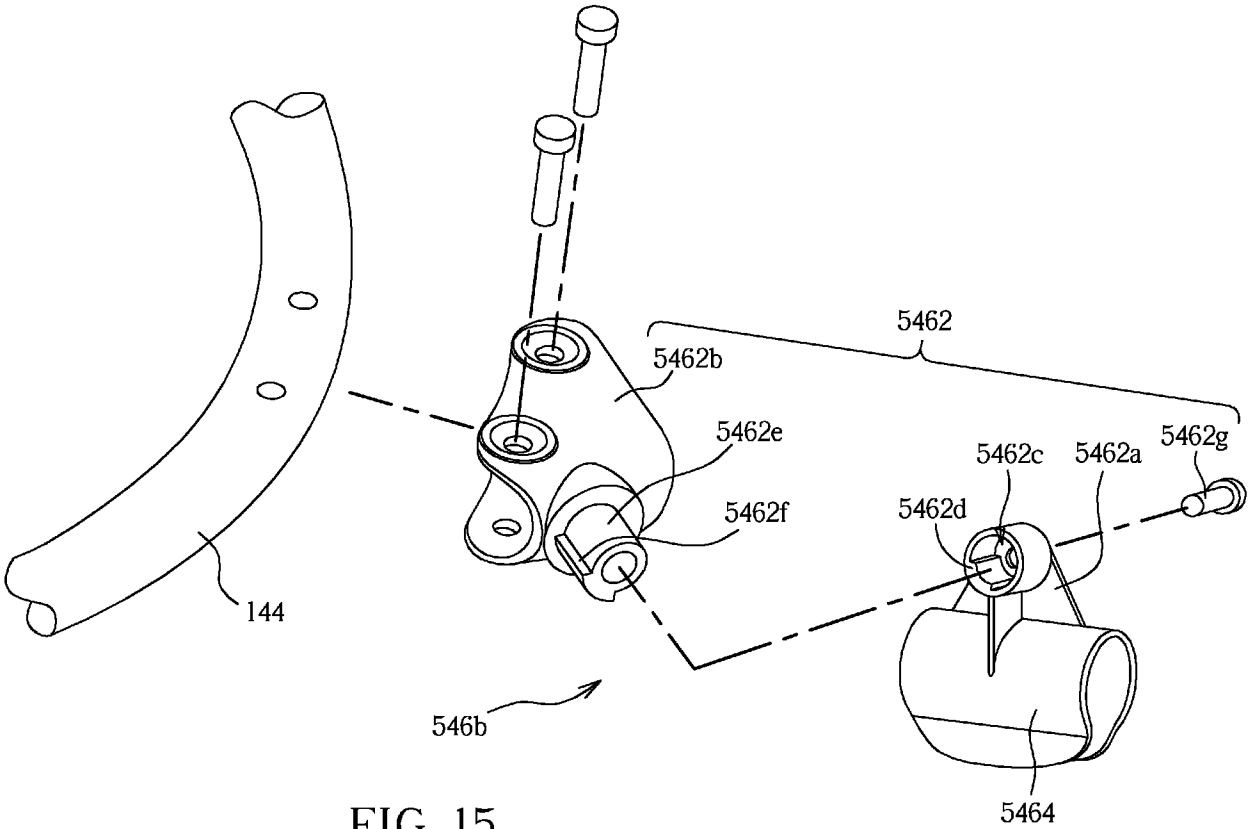
FIG. 15 is an exploded view of a supporting mechanism of a reversible platform of the crib in FIG. 14.
Figure 16:
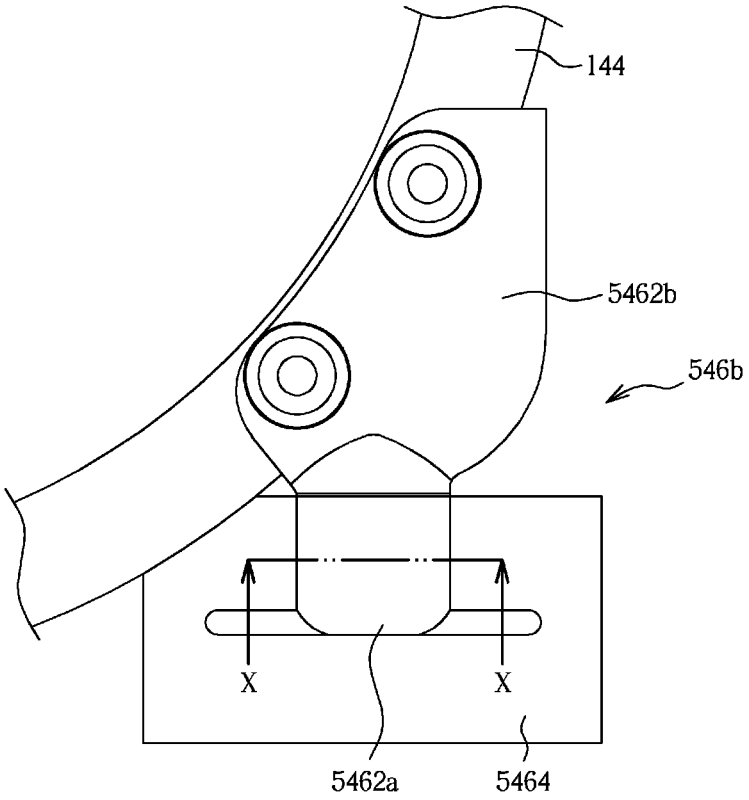
FIG. 16 is a top view of the supporting mechanism in FIG. 14.
Figure 17:
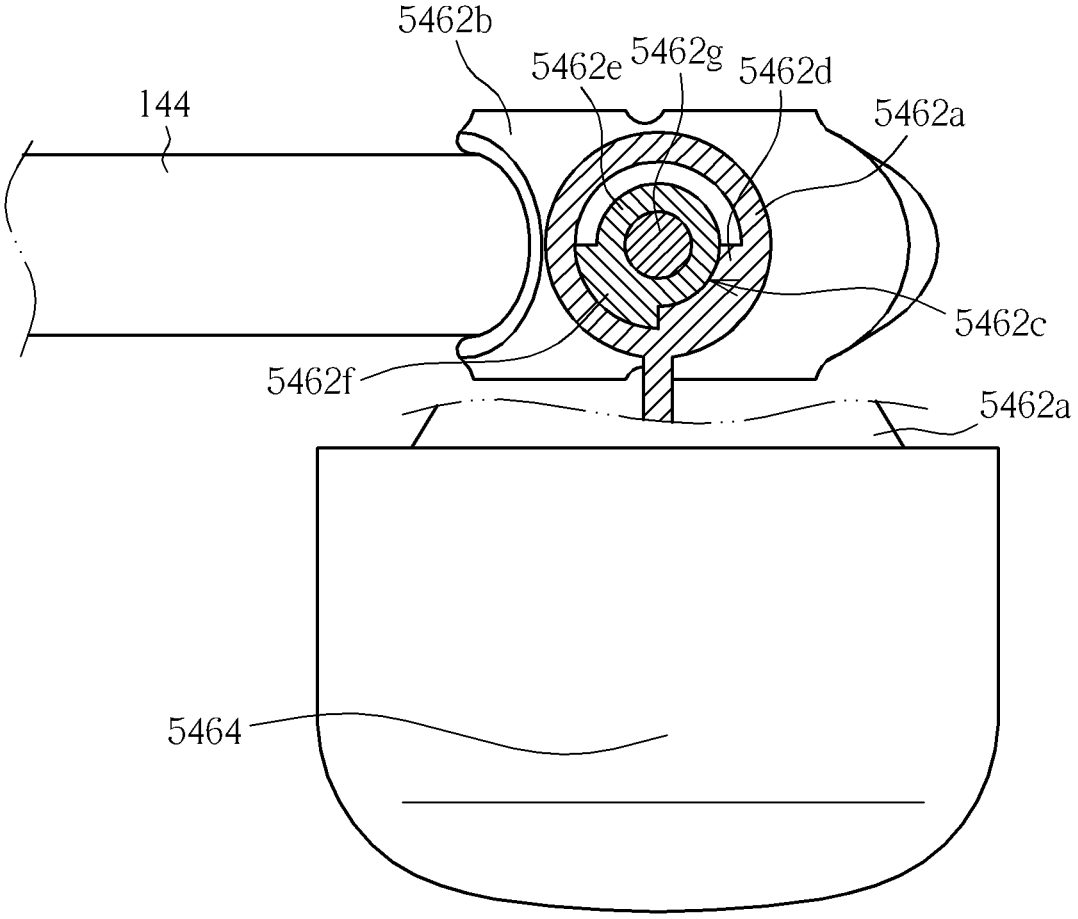
FIG. 17 is a side view of the supporting mechanism partially sectioned along the line X-X in FIG. 16.

Please refer to FIG. 14, which is a schematic diagram illustrating a crib 5 of another preferred embodiment according to the present invention. The crib 5 is structurally similar to the crib 1. The main difference therebetween is that the first and second supporting mechanisms 546*a* and 546*b* of the crib 5 are different to the supporting mechanisms 146*a* and 146*b* of the crib 1. Please also refer to FIGS. 15 through 17. FIG. 15 is an exploded view of the second supporting mechanism 546*b* in FIG. 14. FIG. 16 is a top view of the second supporting mechanism 546*b* in FIG. 14. FIG. 17 is a side view of the second supporting mechanism 546*b* partially sectioned along the line X-X in FIG. 16. In the embodiment, the first and second supporting mechanisms 546*a* and 546*b* are identical, so the following description is based on the second supporting mechanism 546*b*. Hence, the description for the first supporting mechanism 546*a* is not described repeatedly hereinafter.

The second supporting mechanism 546*b* includes a connection part 5462 and a holding part 5464 connected to the connection part 5462. The bracket 144 is connected to the connection part 5462 such that the holding part 5464 is capable of rotating relative to the bracket 144. The holding part 5464 is capable of detachably holding the crib frame 12. In the embodiment, the connection part 5462 includes a support part 5462*a* and a pivot part 5462*b*. The support part 5462*a* is mounted on the holding part 5464 and has a hole 5462*c* and a limitation block 5462*d* formed in the hole 5462*c* . The pivot part 5462*b* is mounted on the bracket 144 with screws or other applicable mounting methods. The pivot part 5462*b* has an axle 5462*e* and a limitation portion 5462*f* formed on the axle 5462*e*. The axle 5462*e* is pivotally disposed in the hole 5462*c* with the limitation portion 5462*f* being limited by the limitation block 5462*d*. In practice, a pin join 5462*g*, for example a bolt probably with a nut, is involved in the engagement of the axle 5462*e* and the hole 5462*c*. Under the limitation on the limitation portion 5462*f* by the limitation block 5462*d*, the support part 5462*a* together with the holding part 5464 can rotate relative to the pivot part 5462*b* (or the bracket 144) within 180 degrees. The limitation block 5462*d* is conducive to positioning the support part 5462*a* together with the holding part 5464; however, in practice, the above limitation design can be omitted so that the support part 5462*a* together with the holding part 5464 can rotate relative to the pivot part 5462*b* free.

In the embodiment, the bracket 144 is polygonal, i.e. rectangular. The first and second supporting mechanisms 546*a* and 546*b* are disposed oppositely relative to the pivotally-engaging mechanism 142 on two corners of the bracket 144, so as to obtain a larger gravity supporting area, formed by the pivotally-engaging mechanism 142 and the first and second supporting mechanisms 546*a* and 546*b*, for supporting the bracket 144 more stably. But the invention is not limited thereto. The description for the supporting mechanisms 146*a* and 146*b* and the variations therefor are also applied to the supporting mechanisms 546*a* and 546*b*, which is not described repeatedly herein.

As discussed in the above embodiments, the reversible platform and the crib therewith of the invention can provide two application platforms with one occupied space of the crib frame, which solves the problem in the prior art that additional accessories provided for a conventional crib is provided for multiple functions occupy more space and the operation therefor is usually inconvenient to users. Furthermore, the reversible platform of the invention can provide application space not limited to the abovementioned applications, i.e. the baby changer and the sleeping napper. In principle, any application capable of using the bracket of the reversible platform is applicable by the invention. In addition, in the above embodiments, the side portions of the bracket are right above the handrails of the crib frame, so in practice the supporting mechanisms can be omitted such that the side portions of the bracket are directly disposed on the handrails of the crib frame. The bracket still can be supported by the crib frame stably.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A reversible platform, comprising:

a pivotally-engaging mechanism disposed on a crib frame;

a bracket pivotally connected to the crib frame through the pivotally-engaging mechanism and having a first side and a second side opposite to the first side, the bracket being capable of being rotated to be disposed selectively with the first side or the second side facing upward for providing application space; and a first supporting mechanism, the first supporting mechanism comprising a connection part and a holding part connected to the connection part, the bracket being connected to the connection part such that the holding part is capable of rotating relative to the bracket, the holding part being capable of detachably holding the crib frame.

2. The reversible platform of claim 1, further comprising a first flexible part and a second flexible part, the first flexible part being mounted on the first side of the bracket, the second flexible part being mounted on the second side of the bracket.

3. The reversible platform of claim 2, wherein the first flexible part and the bracket form a baby changer, and the second flexible part and the bracket form a sleeping napper.

4. The reversible platform of claim 1, wherein the pivotally-engaging mechanism comprises a base part, mounted on the crib frame, and a connection part, pivotally connected to the base part, and the bracket is connected to the connection part.

5. The reversible platform of claim 4, wherein the connection part has a hole, and the bracket is pivotally connected to the connection part by passing through the hole.

6. The reversible platform of claim 5, wherein the connection part has a limitation slot, and the pivotally-engaging mechanism further comprises a limitation part mounted on the bracket and sliding limitedly in the limitation slot.

7. The reversible platform of claim 4, wherein the base part has a hole and a first engagement portion, the connection part has a pivot with a hook, the pivot is disposed in the hole, and the hook is engaged with the first engagement portion.

8. The reversible platform of claim 7, wherein the base part has a second engagement portion engaged with the crib frame.

9. The reversible platform of claim 4, wherein the base part has a socket, and the connection part has a ball portion pivotally disposed in the socket.

10. The reversible platform of claim 9, wherein the connection part has a connecting portion connected to the ball portion, the connecting portion has a hole, and the bracket is connected to the connection part by passing through the hole.

11. The reversible platform of claim 9, wherein the connection part has a connecting portion connected to the ball portion, the connecting portion has a hole, and the bracket passes through the hole and is fixed with the connecting portion by a fixing part.

12. The reversible platform of claim 9, wherein the base part comprises a front casing member and a back casing member, the front casing member has a socket opening portion and a first mounting portion, the back casing member has a socket back cover portion and a second mounting portion, the socket back cover portion is engaged with the socket opening portion to form the socket, the ball portion is disposed in the socket through the socket opening portion, and the first mounting portion and the second mounting portion are engaged with the crib frame.

13. The reversible platform of claim 12, wherein the first mounting portion forms an accommodating space and has a first hook in the accommodating space, the second mounting portion has a second hook disposed in the accommodating space, and the first hook and the second hook are engaged with the crib frame.

14. The reversible platform of claim 13, wherein the first mounting portion has an outer surface and a slot formed on the outer surface, and the second mounting portion has a third hook engaged with the slot.

15. The reversible platform of claim 1, wherein the connection part has a hole, and the bracket is connected to the connection part by passing through the hole.

16. The reversible platform of claim 15, wherein the connection part has a limitation slot, and the first supporting mechanism further comprises a limitation part mounted on the bracket and sliding limitedly in the limitation slot.

17. The reversible platform of claim 1, wherein the connection part comprises a support part and a pivot part, the support part is mounted on the holding part and has a hole and a limitation block formed in the hole, the pivot part is mounted on the bracket and has an axle and a limitation portion formed on the axle, and the axle is pivotally disposed in the hole with the limitation portion being limited by the limitation block.

18. The reversible platform of claim 17, further comprising a second supporting mechanism identical to the first supporting mechanism, the bracket being polygonal, the first supporting mechanism and the second supporting mechanism being disposed oppositely relative to the pivotally-engaging mechanism on two corners of the bracket.

19. The reversible platform of claim 1, further comprising a second supporting mechanism identical to the first supporting mechanism, the first supporting mechanism and the second supporting mechanism being disposed oppositely on the bracket.

20. A crib, comprising:

a crib frame; and a reversible platform disposed on the crib frame, the reversible platform comprising:

a pivotally-engaging mechanism disposed on the crib frame;

a bracket pivotally connected to the crib frame through the pivotally-engaging mechanism and having a first side and a second side opposite to the first side, the bracket being capable of being rotated to be disposed selectively with the first side or the second side facing upward for providing application space; and a first supporting mechanism, the first supporting mechanism comprising a connection part and a holding part connected to the connection part, the bracket is connected to the connection part such that the holding part is capable of rotating relative to the bracket, and the holding part is capable of detachably holding the crib frame.

21. The crib of claim 20, wherein the reversible platform further comprises a first flexible part and a second flexible part, the first flexible part is mounted on the first side of the bracket to form a baby changer, and the second flexible part is mounted on the second side of the bracket to form a sleeping napper.

22. The crib of claim 20, wherein the pivotally-engaging mechanism comprises a base part, mounted on the crib frame, and a connection part pivotally connected to the base part, and the bracket is connected to the connection part.

23. The crib of claim 22, wherein the base part has a socket, and the connection part has a ball portion pivotally disposed in the socket.

24. The crib of claim 23, wherein the base part comprises a front casing member and a back casing member, the front casing member has a socket opening portion and a first mounting portion, the back casing member has a socket back cover portion and a second mounting portion, the socket back cover portion is engaged with the socket opening portion to form the socket, the ball portion is disposed in the socket through the socket opening portion, the first mounting portion forms an accommodating space and has a first hook in the accommodating space and a slot on an outer surface of the first mounting portion, the second mounting portion has a second hook disposed in the accommodating space and a third hook engaged with the slot, and the first hook and the second hook are engaged with a mounting base of the crib frame.

25. The crib of claim 20, wherein the connection part comprises a support part and a pivot part, the support part is mounted on the holding part and has a hole and a limitation block formed in the hole, the pivot part is mounted on the bracket and has an axle and a limitation portion formed on the axle, and the axle is pivotally disposed in the hole with the limitation portion being limited by the limitation block.

26. The crib of claim 25, wherein the reversible platform comprises a second supporting mechanism identical to the first supporting mechanism, the second supporting mechanism is connected to the bracket and capable of detachably holding a second handrail of the crib frame, the bracket is polygonal, and the first supporting mechanism and the second supporting mechanism are disposed oppositely relative to the pivotally-engaging mechanism on two corners of the bracket.

27. The crib of claim 20, wherein the reversible platform comprises a second supporting mechanism identical to the first supporting mechanism, and the second supporting mechanism is connected to the bracket and capable of detachably holding a second handrail of the crib frame.

28. The crib of claim 27, wherein the second handrail is opposite to the first handrail.

29. The crib of claim 27, wherein the pivotally-engaging mechanism is between the first supporting mechanism and the second supporting mechanism.

* * * * *